US008316601B2

(12) United States Patent
Cobb

(10) Patent No.: US 8,316,601 B2
(45) Date of Patent: Nov. 27, 2012

(54) UNDER DECK DRAINAGE SYSTEM

(76) Inventor: Tony Cobb, Grandville, MI (US)

( * ) Notice: Subject to any disclaimer, the term of this patent is extended or adjusted under 35 U.S.C. 154(b) by 88 days.

(21) Appl. No.: 12/817,241

(22) Filed: Jun. 17, 2010

(65) Prior Publication Data

US 2011/0308639 A1 Dec. 22, 2011

(51) Int. Cl.
*E04B 1/70* (2006.01)
*E04B 5/00* (2006.01)

(52) U.S. Cl. ..... 52/302.3; 52/302.1; 137/357; 137/362

(58) Field of Classification Search ..... 137/356, 137/357, 362; 52/302.1, 302.3, 483.1, 302.4
See application file for complete search history.

(56) References Cited

U.S. PATENT DOCUMENTS 2,153,320 A * 4/1939 Venxie ..... 52/508
2,642,968 A * 6/1953 Roush et al. ..... 52/520
3,046,852 A * 7/1962 Graham ..... 52/581
3,276,171 A * 10/1966 Brown ..... 52/86
3,462,906 A * 8/1969 Schroyer ..... 52/478
4,137,682 A * 2/1979 Trumper ..... 52/302.3
4,599,840 A * 7/1986 Ingvarsson et al. ..... 52/340
4,736,564 A * 4/1988 Gailey ..... 52/506.07
4,817,343 A * 4/1989 Rutledge ..... 52/22
4,916,875 A * 4/1990 Kashiwagi ..... 52/302.3
5,287,671 A * 2/1994 Ueki ..... 52/588.1
5,417,025 A * 5/1995 Nute et al. ..... 52/483.1
5,511,351 A * 4/1996 Moore ..... 52/302.1
5,749,282 A * 5/1998 Brow et al. ..... 52/235
5,765,328 A * 6/1998 Moore ..... 52/302.1
6,009,679 A * 1/2000 Larsen ..... 52/578
6,226,941 B1 * 5/2001 Stevens ..... 52/302.3
6,338,228 B1 * 1/2002 Chevalier ..... 52/220.6
6,415,571 B2 * 7/2002 Risser ..... 52/302.1
6,688,059 B1 * 2/2004 Walker ..... 52/302.3
6,796,092 B1 * 9/2004 Goebel ..... 52/302.1
7,028,437 B2 * 4/2006 Hauck ..... 52/302.1
(Continued)

OTHER PUBLICATIONS

Underdeck Oasis, 2011 [retrived on Jan. 26, 2012]. Retrieved from the Internet: <URL: http://underdeckoasis.com/installation.html>.*

*Primary Examiner* — John Rivell
*Assistant Examiner* — Jonathan Waddy
(74) *Attorney, Agent, or Firm* — The Watson I.P. Group, PLC; Jovan N. Jovanovic; Vladon M. Vasiljevic

(57) ABSTRACT

A drainage system comprising a frame and a plurality of drainage basins. The frame has at least three pairs of frame engaging elements. Each drainage basin has an outer and an inner surface. Additionally each has a central region with first and second side ends, as well as, first and second frame engaging structures. The first frame engaging structure is positioned at the first side end and includes an inwardly directed leg having a retention lip engagement flange configured to engage one of the frame engaging elements. The second frame engaging structure is positioned at the second side end and includes an inwardly directed leg having an inboard retention lip engagement nub and an outboard retention lip engagement flange configured to engage opposing adjacent frame engaging elements. A slot covering flange extends over the first frame engaging structure. The slot covering flange covers the area formed by the cooperation of the first frame engaging structure of a first drainage basin with the second frame engaging structure of a second drainage basin.

9 Claims, 5 Drawing Sheets

U.S. PATENT DOCUMENTS

| | | | | |
|---|---|---|---|---|
| 7,051,485 | B2 * | 5/2006 | Burnette | 52/578 |
| 7,234,281 | B2 * | 6/2007 | Hauck | 52/302.3 |
| 7,322,157 | B2 * | 1/2008 | Hang | 52/506.08 |
| 7,434,358 | B2 * | 10/2008 | Smith | 52/14 |
| 8,082,712 | B1 * | 12/2011 | Butler et al. | 52/302.1 |
| 2002/0100248 | A1 * | 8/2002 | D'agata | 52/763 |
| 2002/0144479 | A1 * | 10/2002 | Chun et al. | 52/478 |
| 2003/0074850 | A1 * | 4/2003 | Ready et al. | 52/302.1 |
| 2004/0020136 | A1 * | 2/2004 | Hauck | 52/11 |
| 2007/0144090 | A1 * | 6/2007 | Nguyen | 52/251 |
| 2007/0271866 | A1 * | 11/2007 | Stevens | 52/483.1 |
| 2009/0266018 | A1 * | 10/2009 | Stockton | 52/302.3 |

* cited by examiner

UNDER DECK DRAINAGE SYSTEM

BACKGROUND OF THE DISCLOSURE

1. Field of the Disclosure

The disclosure relates in general to a drainage system, and more particularly, to an under deck drainage system. The under deck drainage system is configured for use elsewhere other than under a deck, and the use of the deck structure is for exemplary purposes and not to be deemed limiting.

2. Background Art

The use of under deck drainage systems is known in the art. Such drainage systems provide drainage of the rainwater and runoff that falls in the gaps between adjoining boards of a deck structure. Without such systems, rainwater and runoff will drip and run between the boards. Typically, such runoff and rainwater tend to create gullies and standing water under a deck. In other instances the same can damage or destroy landscaping.

Problematically, most under deck drainage systems are directed solely to handle the water that is directed through a deck. However, in many instances, homeowners are building structures under the deck for additional living space or additional storage space. As these structures are built below the deck drainage system, it would be advantageous to utilize the drainage system as the ceiling of such structures. However, due to their configurations, a plurality of gaps and openings exist for insects and other creatures to enter into the structure. It is often difficult, impractical and otherwise problematic to seal all of these openings.

It is an object of the present disclosure to overcome the deficiencies of the prior art and to provide an under deck drainage system (or other structure) which can be utilized as the ceiling of a structure placed below the drainage system.

This object as well as other objects of the present invention will become apparent in light of the present specification, claims, and drawings.

SUMMARY OF THE DISCLOSURE

The disclosure is directed to a drainage system typically utilized under a deck or other outdoor structure. The disclosure is not limited to use under a deck, but the use under a deck is for illustrative purposes as the disclosure is well suited for such use. The drainage system comprises a frame and a plurality of drainage basins. The frame has at least three pairs of frame engaging elements. Each drainage basin has an outer and an inner surface. Additionally each has a central region with first and second side ends, as well as, first and second frame engaging structures. The first frame engaging structure is positioned at the first side end and includes an inwardly directed leg having a retention lip engagement flange configured to engage one of the frame engaging elements. The second frame engaging structure is positioned at the second side end and includes an inwardly directed leg having an inboard retention lip engagement nub and an outboard retention lip engagement flange configured to engage opposing adjacent frame engaging elements. A slot covering flange extends over the first frame engaging structure. The slot covering flange covers the area formed by the cooperation of the first frame engaging structure of a first drainage basin with the second frame engaging structure of a second drainage basin.

In a preferred embodiment, each drainage basin is formed from a single sheet of material and the slot covering flange is formed from an overlapped portion of the single sheet of material.

In another preferred embodiment, the slot covering flange abuts the central region of an immediately adjacent drainage basin in an installed configuration.

In yet another preferred embodiment, the drainage basins each comprise an aluminum sheet of material.

Preferably, the drainage basin has a length of between three and twenty feet.

In a preferred embodiment, the drainage basin has a width of between two and ten inches.

In another preferred embodiment, the width of the central region exceeds that of the slot covering flange.

In another aspect of the disclosure, the disclosure is directed to a drainage basin for use in a drainage system of the type described. Such a drainage basin includes a central region and first and second side ends. Additionally, the drainage basin includes a first frame engaging structure positioned at the first side end. The first frame engaging structure has an inwardly directed leg having a retention lip engagement flange configured to engage a frame engaging element of a frame. A second frame engaging structure is positioned at the second side end. It includes an inwardly directed leg having an inboard retention lip engagement nub and an outboard retention lip engagement flange configured to engage a frame engaging element of a frame. Finally, a slot covering flange extends over the first frame engaging structure. The slot covering flange covers the area formed by the cooperation of the first frame engaging structure of the drainage basin with a second frame engaging structure of a second drainage basin.

BRIEF DESCRIPTION OF THE DRAWINGS

The disclosure will now be described with reference to the drawings wherein.

DETAILED DESCRIPTION OF THE DISCLOSURE

Figure 1:
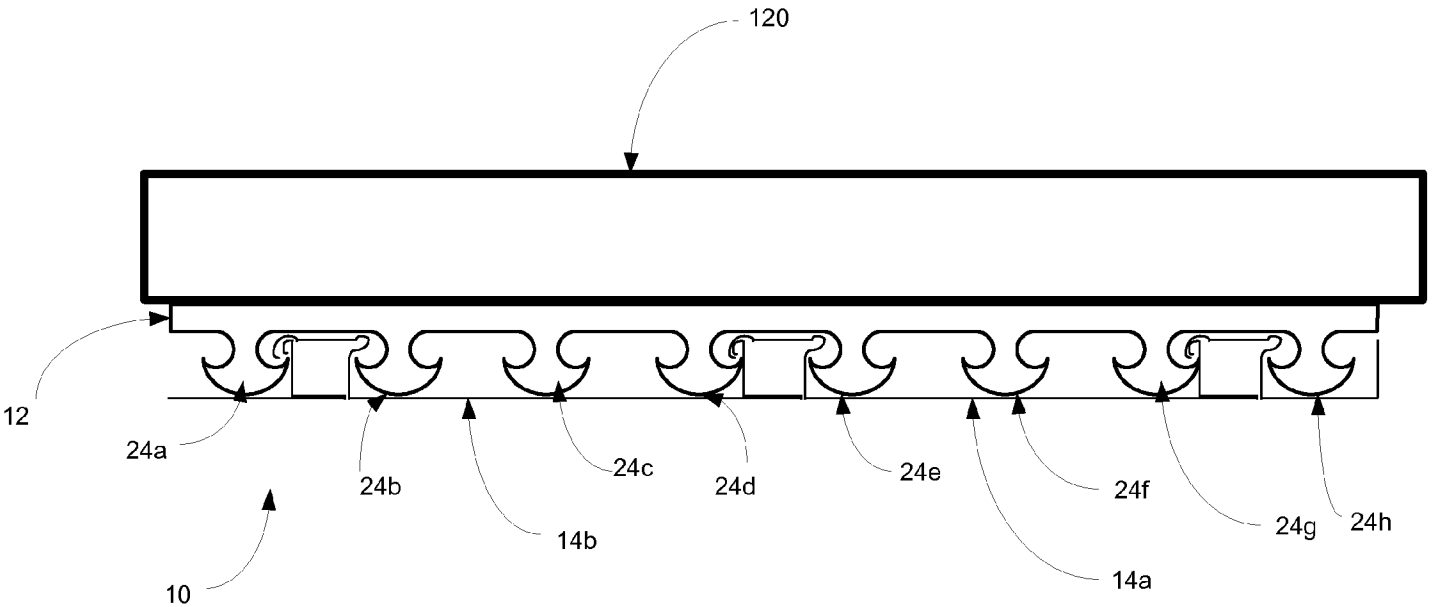
FIG. 1 of the drawings is a side elevational view of an embodiment of the drainage system of the present disclosure, showing, in particular, attachment to a deck structure 120.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the under deck drainage system is shown generally at 10. The under deck drainage system includes frame 12 and drainage basins, such as drainage basin 14. The under deck drainage system 10 is typically utilized under a deck, such as deck 120, as the ceiling for a three season room or a sunroom. In other instances, it is utilized merely to assist with drainage from below a deck. In many instances, such drainage minimizes damage and runoff relative to the surrounding landscaping.

The frame 12 comprises a plurality of members that are spaced apart and attached to the underside of a deck. For example, a plurality of frames extend either across the width of the deck, or across the length of the deck. Each of the plurality of frames is positioned substantially parallel to each other and spaced apart from each other a predetermined distance. For example, the spacing of the separate frame lengths can match the spacing of the underlying beams, or 16" on center. Of course, other spacing is likewise contemplated, such as 12", 24", 32", among others. The particular layout below the deck or the particular spacing and position of each of the frame lengths disclosed is not to be deemed limiting, but is rather to be illustrative of the various combinations that are contemplated.

Figure 2:
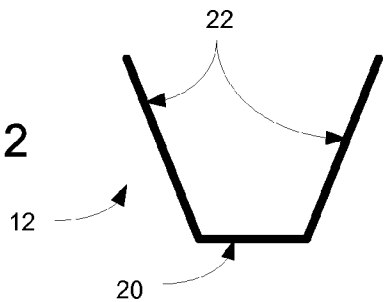
FIG. 2 of the drawings is a front plan view of the frame of the present disclosure.

With reference to FIG. 2, each frame 12 is substantially identical in configuration (that is, functional configuration), and includes base 20 and frame engaging assembly 22. Typically, the base includes a plurality of openings through which fasteners are driven and into the deck to secure the frame to the underside of the deck. The frame engaging assembly 22 includes a pair of rows of spaced apart frame engaging elements. It will be understood that the two rows are positioned so that the frame engaging elements of one of the rows correspond to frame engaging elements on the other of the rows. The frame is typically formed from a stamped metal sheet, although other materials, such as various polymers are likewise contemplated. Additionally, it will be understood that while the frame is shown as being substantially uniform, other configurations are contemplated, including but not limited to configurations which include different (and not necessarily uniform) frame engaging elements, a single row of engaging elements, and the like.

Inasmuch as the two rows are substantially identical, one of the rows will be described, and in particular a few of the frame engaging elements which are also substantially identical in functional configuration. Specifically, eight separate frame engaging elements 24*a* through 24*h*. With respect to the features of the frame engaging elements, the frame engaging element 24*a* will be described with the understanding that the frame engaging elements 24*b* through 24*h* are substantially identical.

Figure 3:
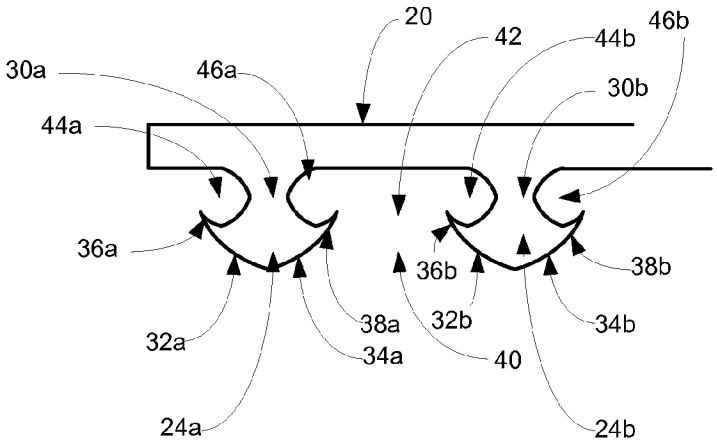
FIG. 3 of the drawings is a partial side elevational view of the frame of the drainage system of the present disclosure.

With reference to FIG. 3, more specifically, frame engaging element 24*a* includes trunk 30*a*, first side protrusion 32*a* and second side protrusion 34*a*. The two side protrusions 32*a*, 34*a* extend in generally opposite directions from trunk 30*a* which itself emanates from base 20. The first side protrusion 32*a* further includes a first retention lip 36*a* at a terminating end thereof. Similarly, the second side protrusion 34*a* further includes a second retention lip 38*a* at a terminating end thereof. In the embodiment shown, the two side protrusions are substantial mirror images of each other about a longitudinal axis bisecting the trunk 30*a*. Of course, other configurations are likewise contemplated, such as non-uniform protrusions, or differently shaped protrusions.

Figure 4:
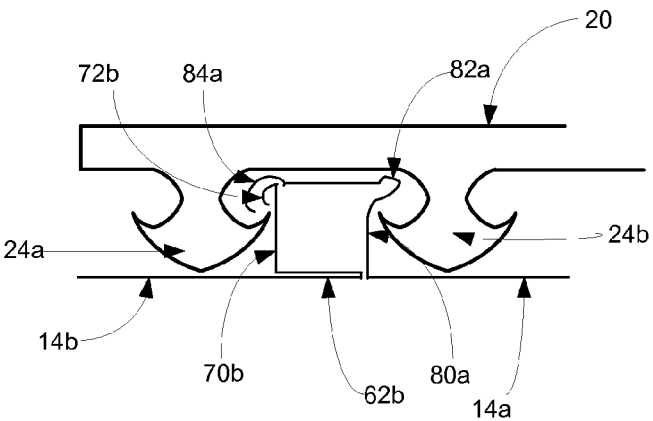
FIG. 4 of the drawings is a partial side elevational view of the drainage system of the present disclosure.

With reference to FIGS. 3 and 4, two side by side frame engaging elements, such as elements 24*a* and 24*b*, together define a receiving region 40. The receiving region 40 includes passageway 42 which extends between the second side protrusion 34*a* of the frame engaging element 24*a* and the first side protrusion 32*b* of the frame engaging element 24*b*. Similarly, a first retaining region 46*a* is defined by the base 20 trunk 30*a* and the second side protrusion 34*a*. A second retaining region 44*b* is defined by the base 20 trunk 30*b* and the first side protrusion 32*b*. As will be explained below, the first and second frame engagement structures extend into the receiving regions, such as receiving region 40 so as to engage the frame and to be releasably maintained thereagainst.

Figure 5:
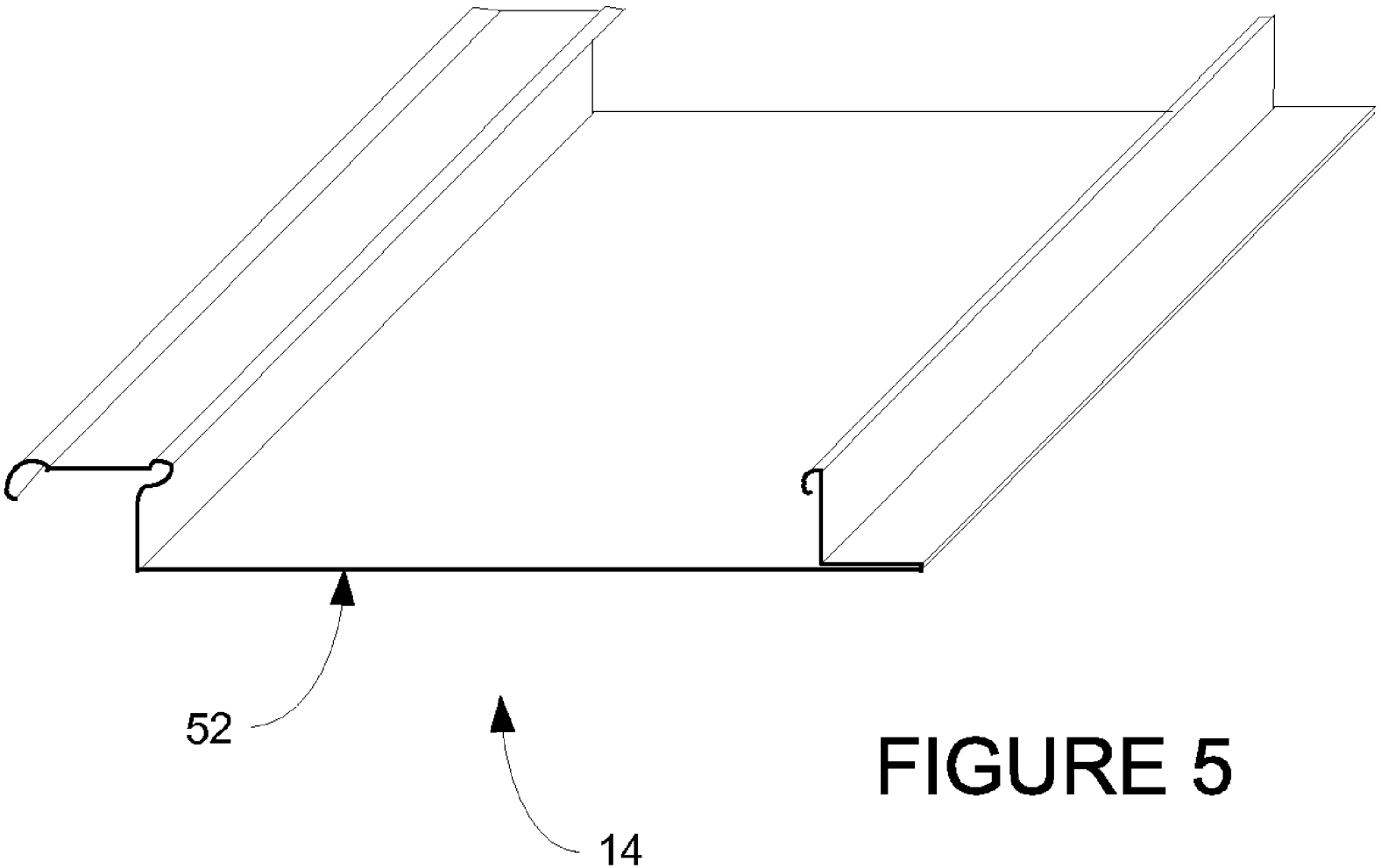
FIG. 5 of the drawings is a perspective view of a drainage basin of the present disclosure.

With reference to FIG. 5, the drainage basins are shown generally at 14 as having a length and a width. The drainage basins are typically elongated metal sheets that are bent to be formed into the appropriate cross-sectional configuration, such as cross-sectional configuration 52. In general, a single sheet of material is utilized to form each drainage basin. Additionally, as the drainage basins are typically substantially identical in functional configuration, although the widths may be varied to suit particular applications. Generally, and functionally, the first and second frame engagement structures are substantially identical. Thus, a single drainage basin will be described with the understanding that the other drainage basins are substantially functionally identical.

Figure 6:
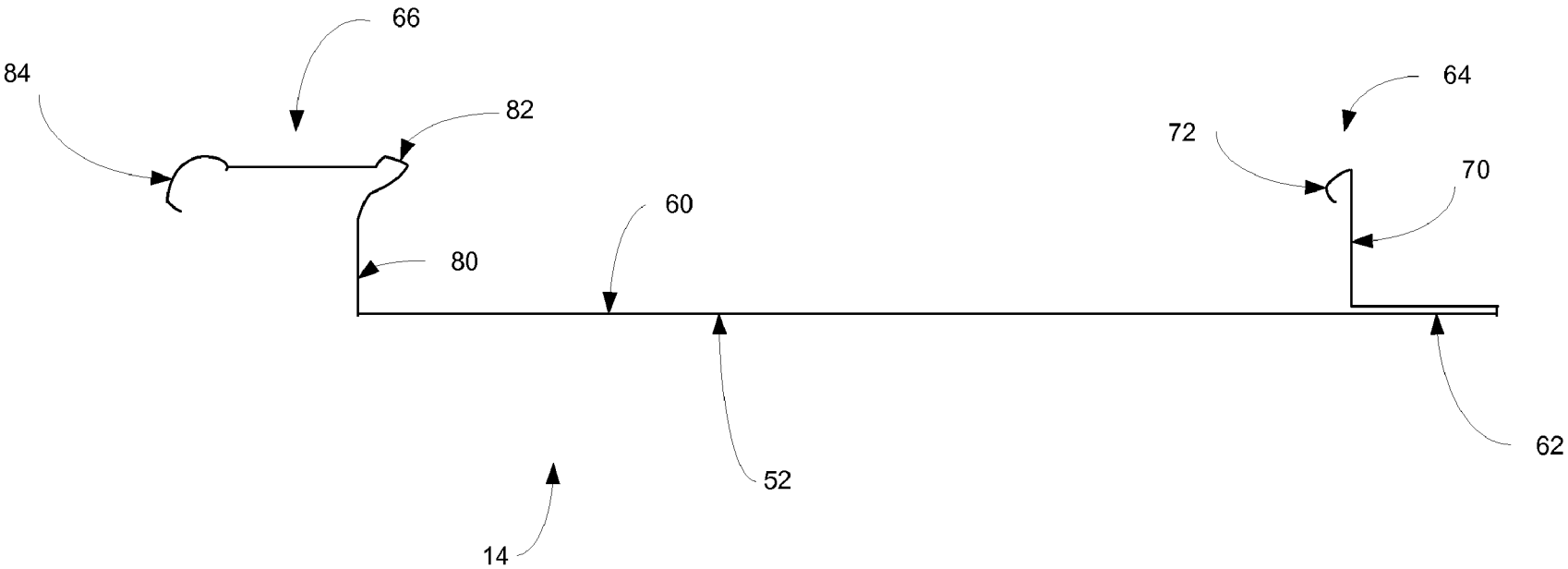
FIG. 6 of the drawings is a side elevational view of the drainage basin of the present disclosure.

More specifically, and with reference to FIG. 6, the drainage basin 14 includes cross sectional configuration 52 which includes central region 60, slot covering flange 62, first frame engaging structure 64 and second frame engaging structure 66. The central region 60 typically has a width that spans multiple frame engaging elements. While various configurations are contemplated, the configuration shown has a substantially planar configuration. Other configurations having drainage channels, or reinforcing ribs or other structures is likewise contemplated.

At one end of the central region, the slot covering flange is disposed. The slot covering flange essentially comprises a folded over two ply portion of sheet from which the drainage basin is formed. The slot covering flange covers the slot that is formed when two drainage basins are sequentially joined together in a side by side orientation. Generally, the upper portion of the folded over two ply portion is substantially planar with the central region.

The first frame engaging structure 64 includes inward leg 70 which extends from the lower portion of the folded over two ply portion and defines the width of the slot covering flange. The inward leg 70 terminates at retention lip engagement flange 72, which is configured to extend into the respective opposing retaining region 46*a*, 46*b*, and to engage, directly or indirectly, one of the retention lips 38*a*, 38*b* of the respective protrusions.

The second frame engaging structure 66 is shown in FIG. 6 as comprising inward leg 80, inboard retention lip engaging nub 82 and outboard retention lip engaging flange 84, in a substantially L-shaped structure. The depth of the first and second frame engaging structures are substantially similar so that they can nest relative to each other when adjoining drainage basins are attached together. A ridge (not shown) can be is formed between the inboard retention lip engaging nub 82 and the outboard retention lip engaging flange 84 to enhance rigidity and to further enhance the nesting engagement between the various components.

The construction will be explained with respect to the placement of two adjoining drainage basins with the understanding that additional drainage basins can be added sequentially along the frame.

Specifically, first at least one frame is attached to the underside of the deck or other structure from which proper drainage through the under deck drainage system is required. The individual frame members typically come in a standard length, such as 10 feet, 12 feet, 14 feet or 16 feet, although they are not limited thereto. Often it is necessary to cut a longer frame to a desired length that matches that which is required. In other embodiments, custom lengths may be provided. In other configurations it may be necessary to butt up two or more frame members sequentially to arrive at the proper configuration.

The frame is coupled to the underside of the deck by way of wood screws or the like. In certain embodiments, other types of screws, nails, adhesives and the like can be utilized. Typically multiple frames can be utilized, wherein the frames are generally positioned in parallel and in a spaced apart orientation. Generally, the frames can be spaced apart every 32 to 48 inches (corresponding to every other or every third deck beam in a substantially standard construction of beams 16 inches on center). Significantly, it is typically necessary to mount the frames in such a way that the frame engaging elements generally correspond to each other across the several frames. This will assist with the proper positioning of the drainage basins and the proper coupling of the drainage basins to the underlying frames.

Once the frames have been installed, then the drainage basins can be installed. Typically, the drainage basins are formed from a steel or an aluminum material and have some flexibility and deformability, both plastic and elastic. The drainage basins can have a design or a surface configuration imprinted or otherwise applied to the outside surface thereof. Additionally, the drainage basins can be painted, electroplated, anodized or otherwise colored so as to be available in a number of different colors and styles.

With reference to FIG. 1, the initial drainage basin is first installed. The installation will be shown with respect to how it joins with frame engaging elements of one of the rows of one of the frames with the understanding that further coupling is achieved in a similar manner. Specifically, the second frame engagement structure is first introduced between two adjoining frame engaging elements. This is achieved by inserting the second frame engaging structure through the passageway and manipulating (which may require both rotation and translative movement) the second frame engaging structure until the inboard retention lip engagement nub is positioned within the first opposing retaining region of one frame engaging element while the outboard retention lip engaging flange is positioned within the second opposing retaining region of the adjoining frame engaging element. The nub and the flange are respectively maintained within the regions by way of the first side retention lip and the second side retention lip.

It will be understood that such a position will tend to direct the first frame engaging structure into a receiving region between subsequent frame engaging elements. In certain embodiments, this may be a subsequent set of frame engaging elements, or additional frame engaging elements may be positioned therebetween. The invention is not limited to any particular spacing of the frame engaging elements, or the width of any one or more of the drainage basins.

More particularly, the inward leg of the first frame engaging structure is directed into the passageway and engages the second side retention lip of the adjacent frame engaging element. At such time, this particular drainage basin has been fully installed. The subsequent drainage basin is then ready for installation.

To install the subsequent drainage basin, the user grasps a second drainage basin and determines into which receiving region the second frame engagement structure should be positioned so that the first frame engagement structure is directed to overlie the second frame engagement structure of an immediately preceding drainage basin. Once the proper receiving region has been determined, the second frame engagement structure of the second drainage basin is directed into the appropriate receiving region. As was explained above, the second frame engagement structure is manipulated so that the inboard retention lip engagement nub is properly positioned within the first opposing retaining region and held in place by the first side retention lip. Similarly, the outboard retention lip engagement flange is directed into the second opposing retaining region and held in place by the second side retention lip.

As the second frame engagement structure is positioned, the first frame engagement structure is directed into the respective receiving region so that the inward leg is directed beyond the passageway and so that the retention lip engagement flange nests within the outer retention lip engagement flange of the previously positioned drainage basin. In such a configuration, the slot covering flange covers the second frame engagement region of the previously positioned drainage basin and provides abutment to the central region of the previously positioned drainage basin.

Figure 7:
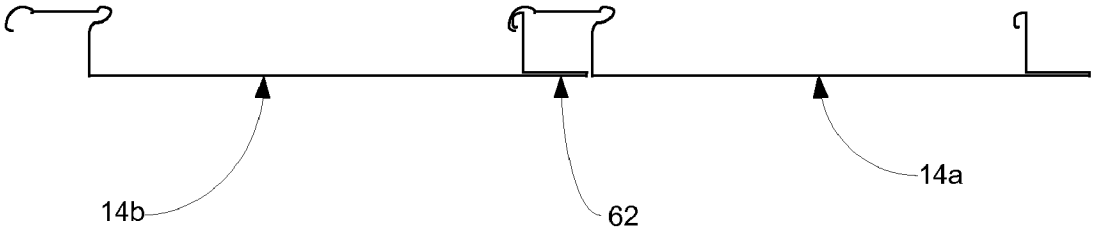
FIG. 7 of the drawings is a partial side elevational view of a pair of drainage basins of the drainage system of the present disclosure.
Figure 8:
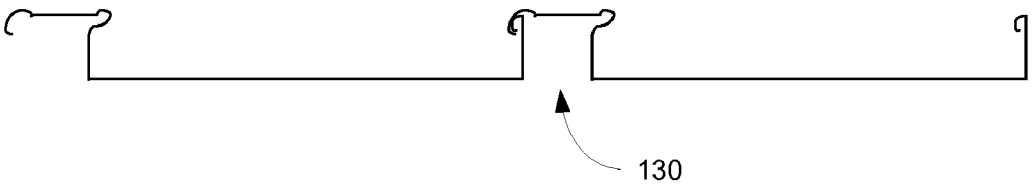
FIGURE 8 Prior Art
FIG. 8 of the drawings is a partial side elevational view of a pair of drainage basins of a prior art drainage system, showing how the lack of a slot covering flange provides a channel which is difficult to seal from the end.

Thus, with the slot covering flange in position, a substantially planar and smooth surface is created by the outside surface of the drainage basins. Without such a slot covering flange, a series of slots exist in a spaced apart fashion along the entirety of the under deck drainage system. With reference to FIGS. 7 and 8, a comparison is made between the prior art under deck drainage system and the drainage system of the present invention. As can be seen, a plurality of end openings 130 are created when the prior art drainage system is fully installed. Conversely, there are no openings that are created with the present drainage system, and if a wall or other structure is formed under the drainage system, the drainage basins provide a substantially uniformly smooth ceiling for such a structure.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A drainage system comprising:

at least one frame having at least three pairs of frame engaging elements;

at least a first and a second drainage basin, each drainage basin having an outer and an inner surface, and being formed from a single sheet of material and further comprising:

a central region and first and second side ends;

a first frame engaging structure positioned at the first side end, the first frame engaging structure comprising an inwardly directed leg having a retention lip engagement flange configured to engage one of the frame engaging elements;

a second frame engaging structure positioned at the second side end, the second frame engaging structure comprising an inwardly directed leg having an inboard retention lip engagement nub and an outboard retention lip engagement flange configured to engage opposing adjacent frame engaging elements; and a slot covering flange extending beyond the first frame engaging structure, whereupon the slot covering flange covers the area formed by the cooperation of the first frame engaging structure of a first drainage basin with the second frame engaging structure of a second drainage basin, the slot covering flange defined by extending the single sheet of material beyond the central region, folding the single sheet of material over itself so as to overlie the portion of the sheet of material that extends beyond the central region a distance substantially dimensionally equal to the outboard retention lip engagement flange of the second frame engaging structure, and terminating at the first frame engaging structure, wherein the first frame engaging structure extends therefrom in a substantially perpendicular orientation to each of the slot covering flange and the central region.

2. The drainage system of claim 1 wherein the drainage basins each comprise an aluminum sheet of material.

3. The drainage system of claim 1 wherein the drainage basin has a length of between three and twenty feet.

4. The drainage system of claim 1 wherein the drainage basin has a width of between two and ten inches.

5. The drainage system of claim 1 wherein the width of the central region exceeds that of the slot covering flange.

6. A drainage basin for use in a drainage system, formed from a single sheet of material, the drainage basin comprising:

a central region and first and second side ends;

a first frame engaging structure positioned at the first side end, the first frame engaging structure comprising an inwardly directed leg having a retention lip engagement flange configured to engage a frame engaging element of a frame;

a second frame engaging structure positioned at the second side end, the second frame engaging structure comprising an inwardly directed leg having an inboard retention lip engagement nub and an outboard retention lip engagement flange configured to engage a frame engaging element of a frame; and a slot covering flange extending beyond the first frame engaging structure, whereupon the slot covering flange covers the area formed by the cooperation of the first frame engaging structure of the drainage basin with a second frame engaging structure of a second drainage basin, the slot covering flange defined by extending the single sheet of material beyond the central region, folding the single sheet of material over itself so as to overlie the portion of the sheet of material that extends beyond the central region a distance substantially dimensionally equal to the outboard retention lip engagement flange of the second frame engaging structure, and terminating at the first frame engaging structure, wherein the first frame engaging structure extends therefrom in a substantially perpendicular orientation to each of the slot covering flange and the central region.

7. The drainage system of claim 6 wherein the drainage basins each comprise an aluminum sheet of material.

8. The drainage system of claim 6 wherein the drainage basin has a length of between three and twenty feet.

9. The drainage system of claim 6 wherein the drainage basin has a width of between two and ten inches.

* * * * *